US006782559B2

(12) United States Patent
Regan

(10) Patent No.: US 6,782,559 B2
(45) Date of Patent: Aug. 31, 2004

(54) PROTECTIVE HOCKEY UNDERGARMENT

(75) Inventor: Paul Regan, Brampton (CA)

(73) Assignee: Jock Plus Hockey Inc., Markham (CA)

( * ) Notice: Subject to any disclaimer, the term of this patent is extended or adjusted under 35 U.S.C. 154(b) by 0 days.

(21) Appl. No.: 10/233,086

(22) Filed: Aug. 30, 2002

(65) Prior Publication Data

US 2003/0056275 A1 Mar. 27, 2003

(30) Foreign Application Priority Data

Sep. 4, 2001 (CA) ..... 2356537

(51) Int. Cl.[7] ..... A41D 13/00
(52) U.S. Cl. ..... 2/455; 2/463; 2/228
(58) Field of Search ..... 2/227, 228, 238, 2/400–406, 455, 463, 2.5, 73, 78.1–78.3, 22–24, 267, 125, 126, 468

(56) References Cited

U.S. PATENT DOCUMENTS

| | | | | | |
|---|---|---|---|---|---|
| 3,501,774 | A | | 3/1970 | Norman | 2/321 |
| 3,670,339 | A | * | 6/1972 | Cooper et al. | 2/22 |
| 3,787,892 | A | * | 1/1974 | Quinn | 2/455 |
| 3,788,314 | A | * | 1/1974 | Noleen | 2/455 X |
| 4,014,044 | A | | 3/1977 | Figueroa et al. | 2/2 |
| 4,035,844 | A | * | 7/1977 | Atack et al. | 2/455 X |
| 4,091,466 | A | * | 5/1978 | Kearn | 2/23 |
| 4,195,362 | A | | 4/1980 | Rolando | 2/2 |
| 4,324,003 | A | | 4/1982 | Johnston | 2/2 |
| D268,142 | S | | 3/1983 | Livernois | D2/27 |
| 4,441,211 | A | | 4/1984 | Donzis | 2/2 |
| 4,449,251 | A | | 5/1984 | Gauthier | 2/2 |
| 4,507,801 | A | | 4/1985 | Kavanagh et al. | 2/2 |
| 4,590,622 | A | | 5/1986 | Wolfe et al. | 2/2 |
| 4,686,710 | A | | 8/1987 | Marston et al. | 2/2 |
| D329,508 | S | | 9/1992 | Fair | D29/10 |
| 5,539,926 | A | * | 7/1996 | Mantos | 2/23 |
| 5,539,927 | A | * | 7/1996 | Holubec | 2/69 |
| 6,038,701 | A | * | 3/2000 | Regan | 2/125 |
| 6,044,498 | A | * | 4/2000 | Schumann et al. | 2/468 |
| 6,141,800 | A | * | 11/2000 | Regan | 2/125 |

FOREIGN PATENT DOCUMENTS

| | | |
|---|---|---|
| CA | 951451 | 7/1974 |
| CA | 1289698 | 10/1991 |
| CA | 1290098 | 10/1991 |
| CA | 2034621 | 7/1992 |
| CA | 2054639 | 5/1993 |
| CH | 638 665 | 10/1983 |
| DE | 34 09 323 A1 | 9/1985 |
| DE | 200 12 709 U1 | 12/2000 |
| FR | 2 340 063 | 9/1977 |

OTHER PUBLICATIONS

Excerpt of Bauer Hockey Catalogue 2002.
Excerpt of Bauer Ice Hockey Collection Catalogue 2001.
Excerpt from Bauer Ice Hockey Collection Catalogue, 2000.
Excerpt from Kobe Sportswear Catalogue, 2000.

(List continued on next page.)

*Primary Examiner*—Gloria M. Hale
(74) *Attorney, Agent, or Firm*—Vidas, Arrett & Steinkraus

(57) ABSTRACT

An undergarment for use by a hockey player comprising a one-piece torso portion having a head opening, leg openings and arm openings; a neck guard assembly comprising an integral neck guard coupled to the torso portion adjacent at the head opening, and a releasable attachment means coupled to the neck guard to permit the neck guard to be securely positioned on a neck of the player; a sock support positioned adjacent to each of the leg openings; an opening to permit the hockey player to don the undergarment; and a zipper positioned so that when closed the undergarment and the sock supports are retained in place on the hockey player.

23 Claims, 5 Drawing Sheets

OTHER PUBLICATIONS

Excerpt from Bauer Ice Hockey Collection Catalogue, 1999.
Excerpt from Bauer (Collection Gardien de But) Catalogue, 1997.
Protexion Products Inc., Workbook, 1997.
Excerpt from Koho/Jofa Catalogue, 1996.
Excerpt from Bauer/Cooper Catalogue, 1996.
Excerpt from Victoriaville Catalogue, 1996.
Excerpt from Vaughn Custom Sports Catalogue, 1993.
Excerpt from Canstar Catalogue, 1993.
Excerpt from Canstar Catalogue, 1992.
Excerpt from DR Catalogue, 1990–1991.
Excerpt from Cooper Catalogue, 1990.
Catalogue of Brad Hall & Co. Ltd., 1989.
Excerpt from Cooper Catalogue, 1988.
Catalogue from Brad Hall & Co. Ltd., undated.
Excerpt of brochure for The Eliminator, undated.

* cited by examiner

PROTECTIVE HOCKEY UNDERGARMENT

FIELD OF THE INVENTION

This invention relates generally to the field of sports equipment, and more particularly to hockey clothing and protective hockey equipment.

BACKGROUND OF THE INVENTION

Hockey is a sport played on ice. The game is played with a hard (usually frozen) rubber puck, and metal- or wooden-shafted sticks. Physical contact between players from opposing teams and their sticks, and even occasionally between players from the same teams, is an integral part of the game of hockey. Hockey is played not only by adults, but by many children as well, and has variations, including ringette, shinny hockey and the like. Because hockey is played on a slippery surface, and often at high speeds, it is impossible to predict during play the nature of contact that may be made between players, or between sticks and pucks, and players.

Thus, various types of protective equipment are typically worn by players. So, for example, there is a serious risk that, during play, a stick or puck will make forceful contact with the genital area of a player, causing pain and possibly injury. Thus, traditionally, male players wear genital protectors (conventionally known as "jocks" or "cups") which are carried in fabric pockets attached to which are elasticized straps worn immediately against the skin, or on top of a pair of conventional underpants, for holding the cup on the player's body.

Another risk during the rough and tumble play of hockey is that a player may be inadvertently cut by a skate. Frequently, hockey players fall to the ice after being body-checked, or otherwise losing their balance. It is in these situations when the blade of another player's skate is most likely to cut the player who has fallen to the ice. Although, such an injury would always be serious, it is potentially life-threatening if the skate cuts the neck of a player. This is because the skate may cut through the trachea of the fallen player, or alternatively, the carotid artery or jugular vein, all of which injuries would be life-threatening.

Another area of the body that may require protection is the wrist of the player. In recent years, hockey gloves, which historically provided some wrist protection, have become shorter and lighter, to permit players better control while stick-handling. However, as a result, the wrists of players are often more exposed than previously. Furthermore, unfortunately, hockey players in the heat of competitive play often slash at other players with their sticks, particularly when trying to take the puck away from those other players. Thus, for both of these reasons, players have in recent years become more susceptible to wrist injuries, including both bone fractures and severe bruising.

Therefore, many players now wear individual wrist guards on each arm, adjacent to the top end of the hockey glove, to protect their wrists and forearms from injury.

As a result, the average hockey player will be required to transport to and from games, and put on and take off before and after games, a large number of small pieces of protective equipment, including wrist guards, a neck guard and a jock strap carrying a jock. Moreover, above and beyond the numerous small pieces of protective equipment, a player would typically have a number of small pieces of clothing to keep track of. Specifically, in addition to the large items of clothing typically worn (helmet, shirt, gloves, hockey socks for covering the player's legs, hockey pants and skates), a player would typically need the following small items of clothing: (1) and extra undershirt to wear during the game under the shoulder pads; (2) an extra pair of underpants to wear under the jock; and (3) a garter or other support garment for holding up the hockey socks.

Three problems arise as a result of a hockey player having so many small pieces of equipment and clothing. The first is that it is easy for individual small pieces of equipment and clothing to be lost or left behind. Thus, for example, when a player is packing his hockey bag at home to go to the rink, he is unlikely to forget any major piece of equipment, such as a helmet, hockey pants or skates. However, he is more likely to accidentally leave behind a small piece of equipment or clothing, which he may not notice, or may mistakenly believe is already in his bag. To ensure that no important piece of equipment or clothing is forgotten, the player would be forced to labouriously check that every necessary piece is in the bag, and in fact, may even find it necessary to draft a checklist, and check the contents of his hockey bag against the checklist before every game to ensure that all necessary pieces of equipment are present.

Similarly, after the hockey game, a player using so many small pieces of equipment and clothing can easily lose such pieces of equipment at the rink, leaving them behind in the change room. A rink change room is a chaotic place after a hockey game. The room is often small and crowded with people. Hockey equipment is strewn about. Multiple conversations are taking place simultaneously. While it is relatively easy for a player to keep track of his large pieces of equipment and clothing, the smaller pieces are easily lost, misplaced or forgotten in the chaotic post-game change room. These small pieces may get lost in any number of ways, such as falling behind the change room benches and out of sight, or getting mixed in with another player's equipment.

For a number of reasons, this problem is particularly severe when the hockey players are children. First, change rooms are even more chaotic after children's hockey games than after adult hockey games. This is because, in addition to being crowded with boisterous children, the change room also contains a supervising adult helping each child get dressed. Second, children are typically less organized and more easily distracted than adults. As such, they are more likely to misplace the smaller pieces of clothing and equipment.

The second problem is that the presence of so many small pieces of equipment makes dressing for a hockey game significantly more difficult in two ways. First, it is simply difficult and time consuming to don a large number of small pieces of hockey clothing and equipment.

Second, if a particular piece of equipment, which must be put on before another piece, is forgotten, the player will have to remove other piece, put on the piece that was forgotten, and replace the other, thus significantly lengthening the process of dressing for a hockey game.

So, for example, if a hockey player mistakenly forgets to put on his jock, and then proceeds to don hockey pants, he will have to remove his hockey pants, put on the jock, and then replace the hockey pants. Similarly, if the hockey pants are donned before the sock support garter is put on, then the pants will have to be removed, the garter put on, and the pants replaced.

This second problem is also more pronounced among children, who, being less organized and more easily distracted, will be more likely to forget to put on a small piece of clothing at the appropriate time.

The third problem is that small pieces of equipment or clothing can get buried at the bottom of the player's hockey bag, and get overlooked when the player washes his equipment. As a result, the small pieces of equipment which are typically soaked by the player's perspiration after use, may not get washed, and may become malodorous.

Canadian Reissue Patent No. 1,290,098 ("the '098 patent") discloses an athletic garment for use in protecting the genital area of a wearer and supporting his hockey socks. The garment includes an inner part and an outer pant. Both are supported from a waistband including a drawstring for supporting the garment. The outer pant has a pocket shaped to receive a genital protector. The inner and outer pants are sized and mutually positioned so as to ensure that the genital protector "floats" above the wearer's genital area. Thus, reliable genital protection is provided while the wearer's comfort is enhanced because the genital protector floats. The outer pant also has integral sock supports.

The '098 patent is directed primarily toward providing a new, more comfortable form of genital protection, and sock supports. However, using the garment of the '098 patent still requires a player to separately don and keep track of a number of small pieces of equipment, including a neck guard, wrist guards, and an undershirt.

Published Canadian Patent Application No. 2,034,621 ("the '621 application") discloses a sports undergarment with attachable protection means. The garment includes VELCRO™ patches around the shoulder area which allow either a shoulder pad assembly or neck protector to be detachably attached to the garment. The garment has an upper body portion, a pant portion and a leg portion. The garment of the '621 application suffers from the problem that the detachable neck protector being a small piece of equipment, may be easily lost by the player. Thus, a player using the garment of the '621 application would need to put particular effort into keeping track of the whereabouts of the neck protector.

U.S. Pat. No. 6,038,701 ("the '701 patent") discloses a protective hockey undershirt with a neck surrounding band of fabric to which a neck guard can be removably or integrally mounted. The undershirt may also have a sleeve cuff assembly carrying a wrist guard on each sleeve.

However, a player wearing undershirt of the '701 patent must still make a special effort to keep track various small pieces of equipment, such as the sock garter and elasticized jock strap, that are needed to hold up the player's socks and provide genital protection.

SUMMARY OF THE INVENTION

Therefore, what is desired is a hockey undergarment which significantly reduces the number of small pieces of hockey clothing and equipment that need to be worn by a hockey player, while still providing the necessary protection. Preferably, the undergarment will be simple and inexpensive to manufacture, and will also be comfortable and easy to put on.

Thus, according to one aspect of the invention, there is provided an undergarment for use by a hockey player, the undergarment comprising:

a torso portion having a head opening, and arm openings;

two pant leg portions extending from the torso portion;

a neck guard assembly comprising an integral neck guard coupled to the torso portion adjacent the head opening, and a releasable attachment means coupled to the neck guard to permit the neck guard to be securely positioned on a neck of the player;

each pant leg portion carrying at least one sock support.

In another aspect of the invention, there is provided an undergarment for use by a hockey player, the undergarment comprising:

a torso portion having a head opening, arm openings, and leg openings;

a neck guard assembly comprising an integral neck guard coupled to the torso portion adjacent the head opening, and a releasable attachment means coupled to the neck guard to permit the neck guard to be securely positioned on the neck of the player;

a genital protector support, the genital protector support being attached to the torso portion and being sized, shaped and positioned to support a genital protector over a genital area of the player.

Preferably, the undergarment further comprises a pair of sleeves, each of the sleeves being attached to the torso portion at a corresponding arm opening, and a sleeve cuff assembly on each of the sleeves distal from the torso portion, each sleeve cuff assembly including a fastening means, the fastening means being sufficiently adjustable to allow a wrist guard to be selectively positioned on a wrist of the player, the sleeve cuff assembly being sized and shaped to retain the wrist guard in the sleeve cuff assembly.

BRIEF DESCRIPTION OF THE DRAWINGS

Reference will now be made, by way of example only, to drawings of the invention which illustrate preferred embodiment of the invention, and in which.

DETAILED DESCRIPTION OF THE PREFERRED EMBODIMENTS

Figure 1:
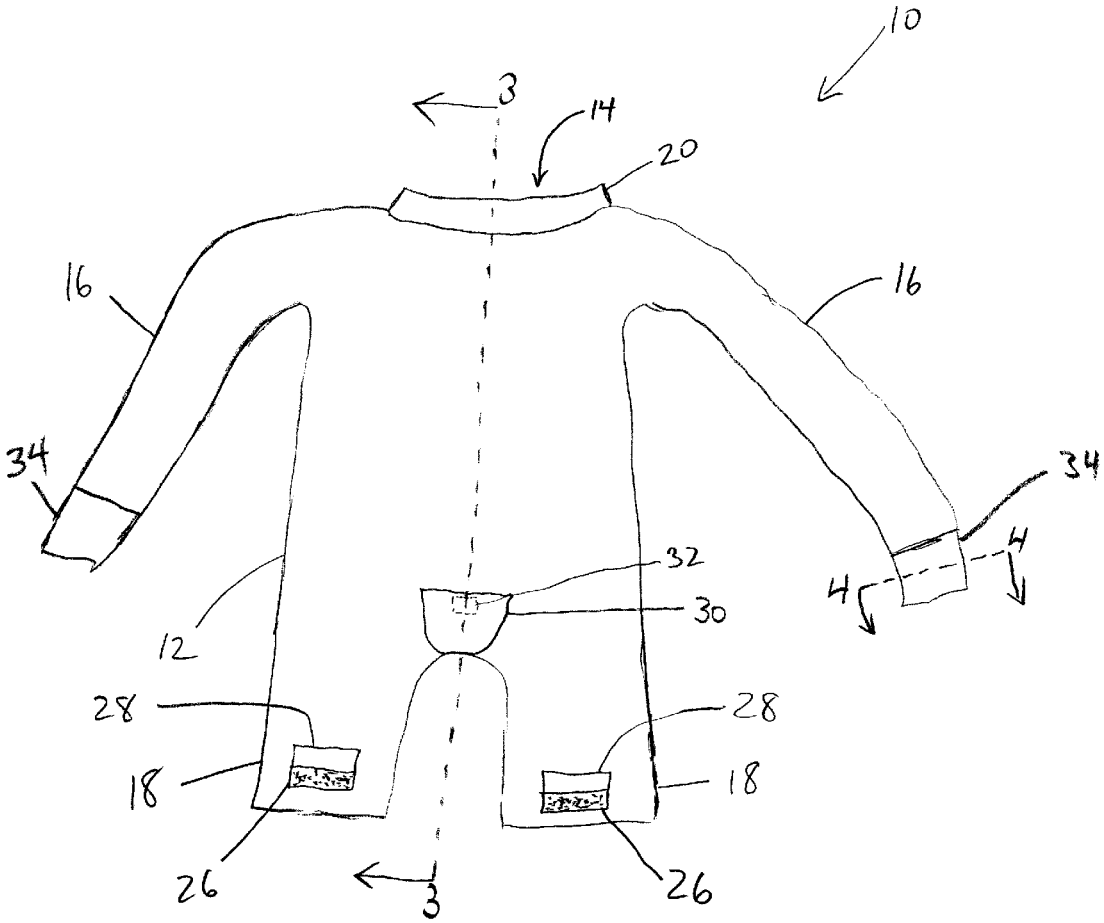
FIG. 1 is a front elevation view of the undergarment of the present invention.
Figure 2A:
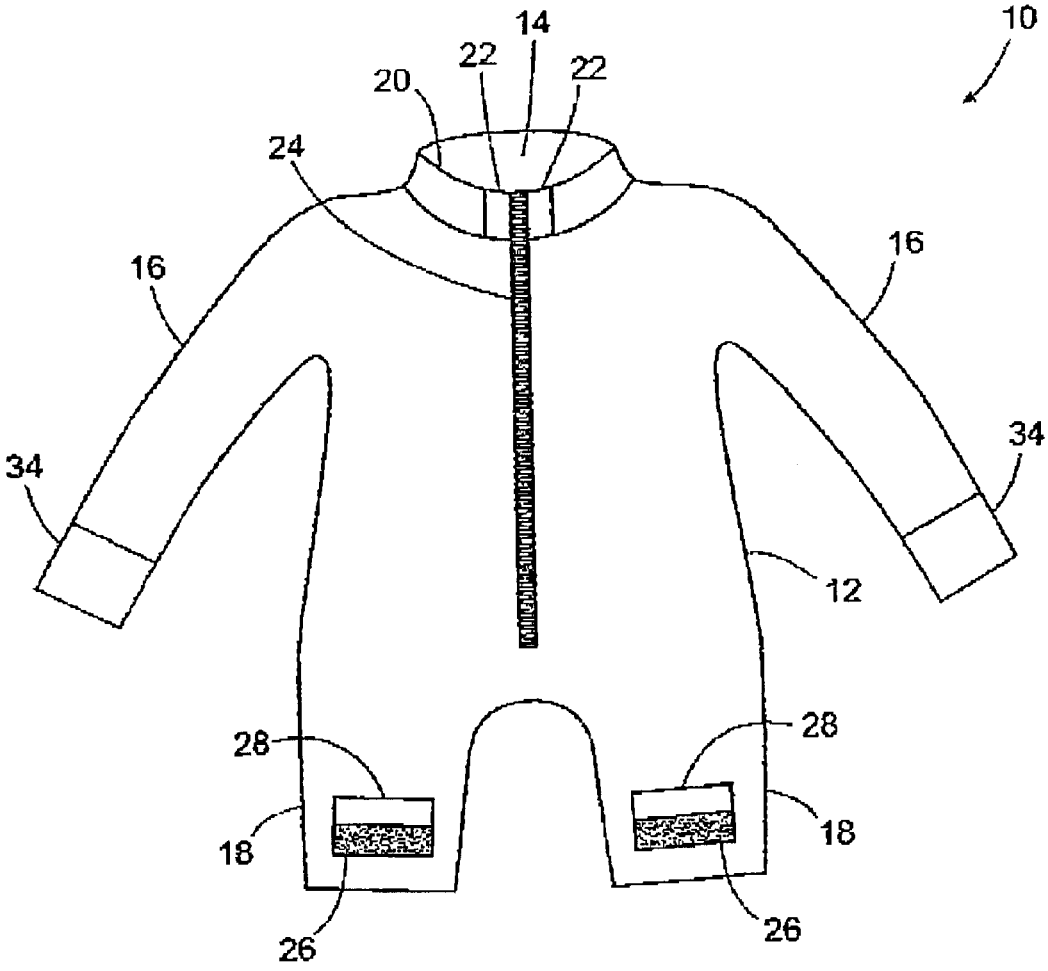
FIG. 2A is the rear elevation view of the undergarment with the closure closed.
Figure 2B:
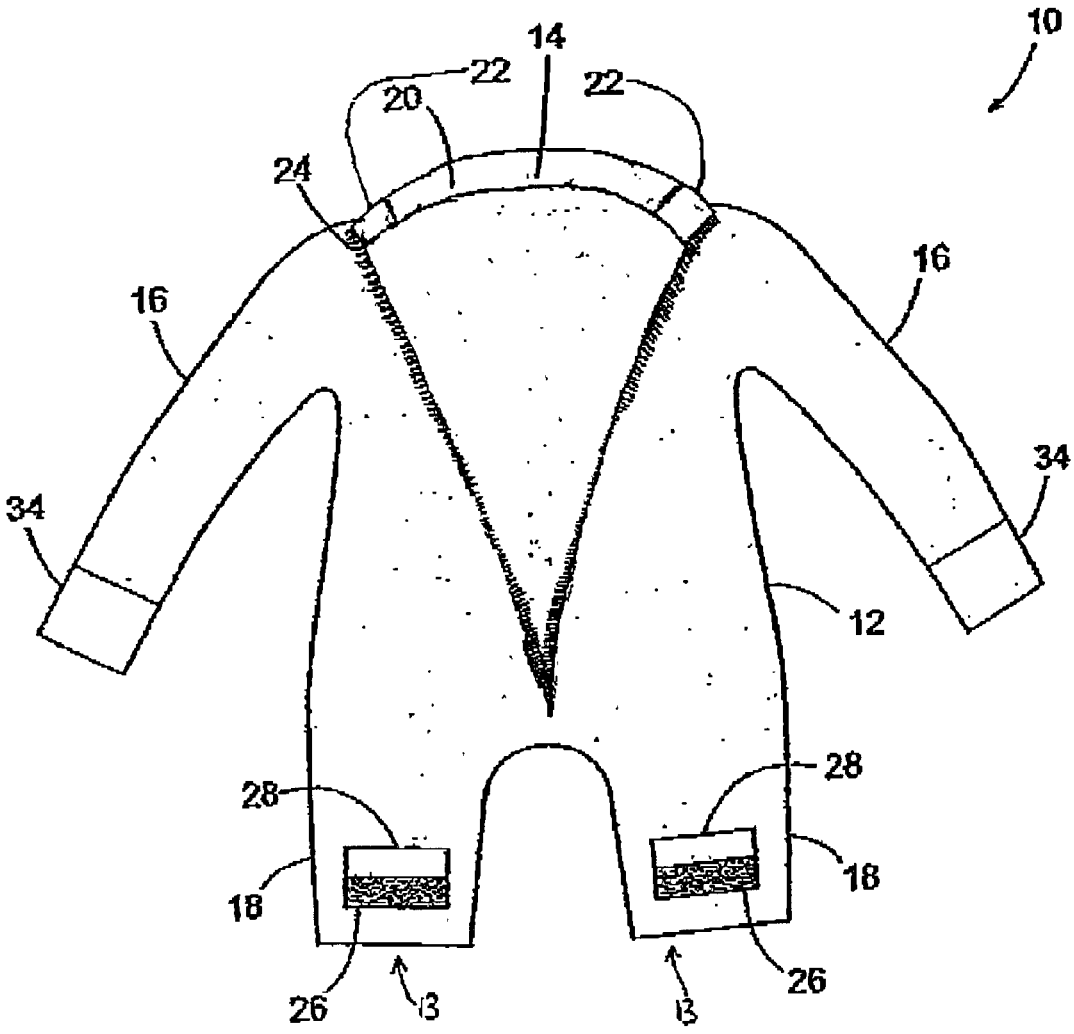
FIG. 2B is a rear elevation view of the undergannent with the closure open.
Figure 3:
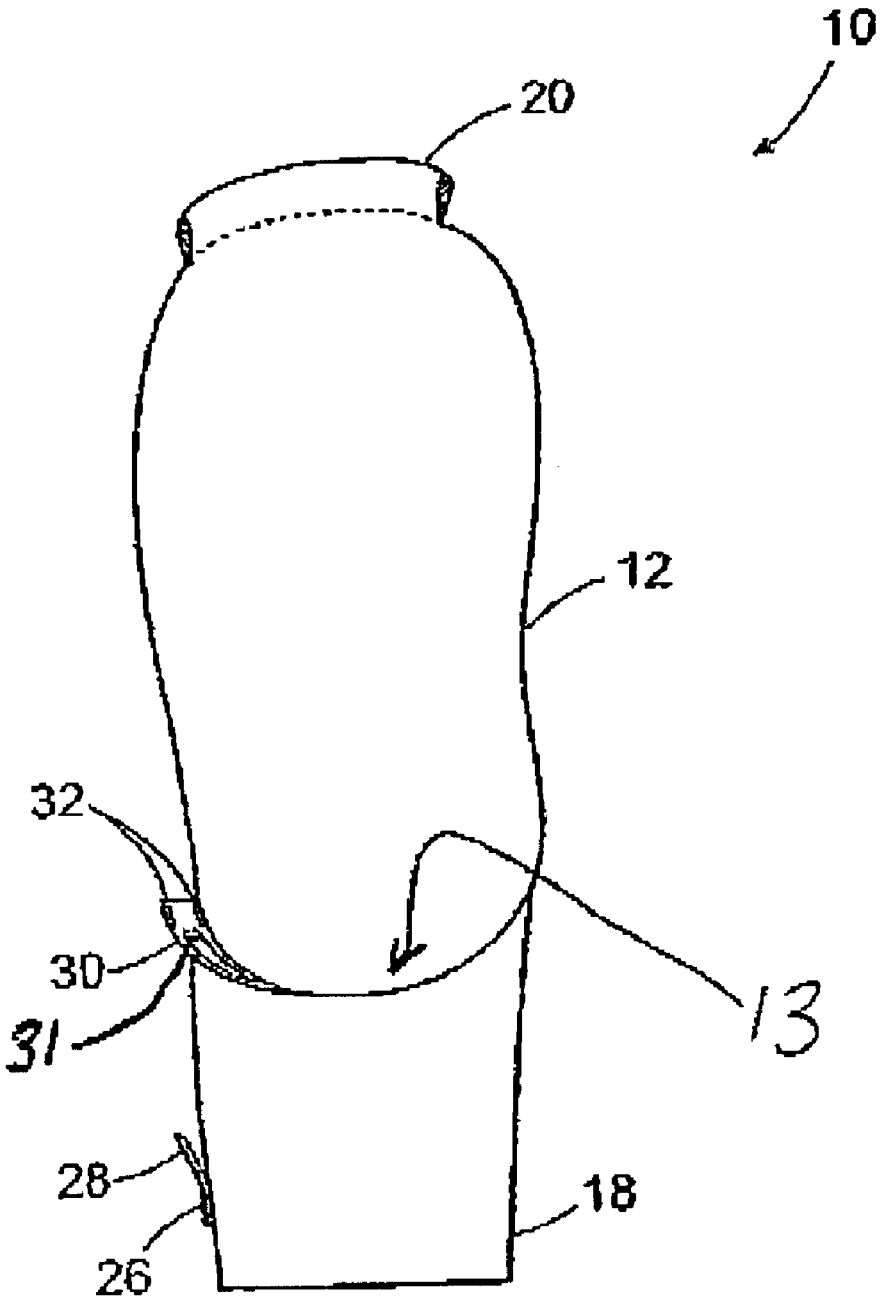
FIG. 3 is a cross-sectional view of the undergannent taken along line 3—3 of FIG. 1.
Figure 4:
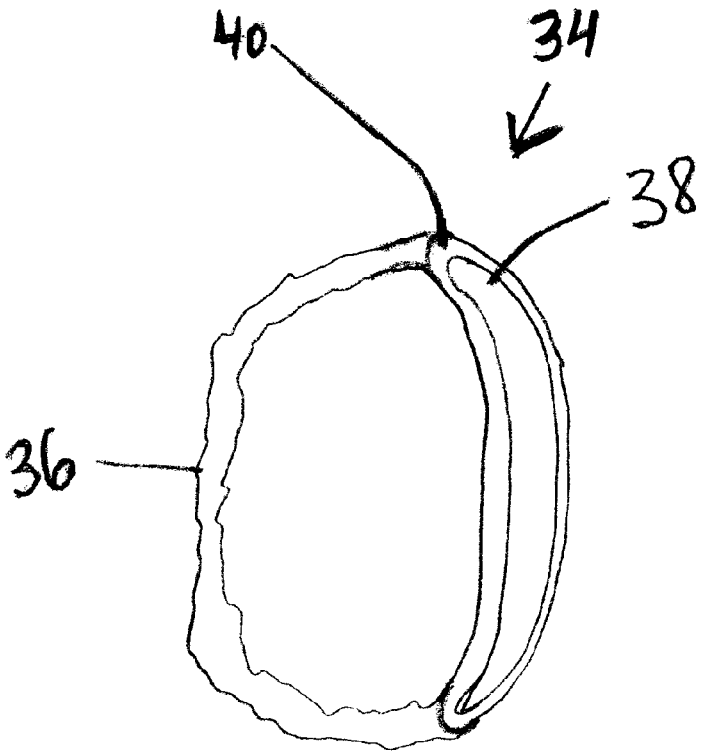
FIG. 4 is a cross sectional view taken along line 4—4 of FIG. 1.

An undergarment 10 for use by hockey players in shown in FIGS. 1–3. The undergarment 10 comprises a torso portion 12 having a head opining 14. The torso portion 12 has a pair of sleeves 16, each of the sleeves 16 being attached to the torso portion at a corresponding arm opening near the top of the torso portion 12. The undergarment 10 further includes two pant leg portions 18 extending from the torso portion 12 at leg openings 13 at the bottom of the torso portion 12.

The undergarment 10 further comprises a neck guard assembly comprising a neck guard 20 coupled to the torso portion 12 at a point adjacent to the head opening 14. The neck guard assembly further comprises a releasable attachment means, preferably in the form of two pieces of elastic material 22 and a zipper 24.

The pieces 22 are each attached to the neck guard 20 at one end, and to the zipper 24 on the other. The pieces 22 are also preferably attached to the torso portion 12. The zipper 24 is thus coupled to the neck guard 20. The zipper 24 is attached to both the pieces 22 and the torso portion 12, such that when the zipper 24 is opened, the neck guard 20 is released. The torso portion 12 is also opened so that the players may insert arms, legs and torso into the undergarment.

It will be appreciated that the zipper 24 and pieces 22 together act as a releasable attachment means to permit the neck guard 20 to be securely positioned on the neck of the player. To don the undergarment 10, the player opens the zipper 24, inserts his legs into the pant leg portions 18, inserts his arms into the sleeves 16, and then reaches back and closes the zipper 24. By closing the zipper 24, the neck guard 20 is positioned around the neck of the player, and the undergarment is retained in place on the player. That is because the neck guard 20 is appropriately positioned near the head opening 14.

The pieces 22 allow for more precise positioning of the neck guard 20 on the neck of the wearer. Specifically, they allow the neck guard 20 to be sized so as to fit snugly around the neck of the player. Thus, the neck guard 20 can be precisely positioned by the wearer on a specific portion of his neck, and, by virtue of the elasticity of the pieces 22, the neck guard 20 will cling snugly yet comfortably to the neck at the desired location.

It will be appreciated that the releasable attachment means can take a form different from the preferred form described above. For example, the neck guard 20 itself may simply be composed of an elasticized material. In such a case the neck guard 20 would be releasable by extending the elasticized material to pull the neck guard 20 off of the wearer's neck, and would attach by snugly clinging to the neck. Thus, the neck guard 20 itself would function as the releasable attachment means. Similarly, though no preferred, the releasable attachment means could consist solely of the zipper 24, as the zipper 24 functions to close the neck guard 20 around the neck of the player. As another example, the releasable attachment means could consist of some other kind of fastener which allows the neck guard 20 to be open or closed, such as a button or a snap, or a VELCRO™ fastener which would hold the neck guard 20 closed around the neck of the player. What is important is that it be possible for a player to securely position the neck guard 20 around his neck.

The neck guard 20 will preferably include at least one layer of cut resistant fabric, such as ballistic nylon. Another suitable fabric is KEVLAR™ fabric, a cut-resistant fabric produced by DuPont.

It will be appreciated that what is important is that the neck guard 20 resist cutting of the neck of the player. Thus, though preferable, it is not necessary that the neck guard 20 include a layer of cut-resistant fabric. For example, the neck guard 20 could include as an alternative, a rigid plastic layer.

Each pant leg portion 18 preferably has attached thereto two sock supports in the form of support patches 26. On each pant leg portion 18, one support patch 26 is located on the front side of the pant leg portion 18 (i.e. so as to be positioned on top of the front of the wearer's leg) and one support patch 26 is located on the back of the pant leg portion 18. It has been found that having two support patches 26 on each pant leg portion 18 provides better support for the hockey socks than having one support patch 26 on each pant leg portion 18, while not unnecessarily lengthening the time needed for the player to attach his socks to the support patches 26. Nevertheless, having only one support patch 26 on each pant leg portion 18 will still typically provide sufficient support for the player's socks.

Preferably, the support patch 26 is a VELCRO™ patch sewn or glued to the pant leg portion 18. It will be appreciated by those skilled in the art that the VELCRO™ system is composed of a filament-like hooks on one side and loops on the other, so that the hooks grasp the loops when the two are brought together. With respect to the present invention, the support patch 26 is preferably composed of the hook portion of the VELCRO™ system. In this way, the player's socks are supported by the hooks, which grasp the fibres of the sock and keep it from falling down.

It will be appreciated that the sock support 26 need not comprise a VELCRO™ support patch 26 as described with respect to the preferred embodiment. Rather, it can be anything that functions to support a sock of the player, such as, for example, a clip, snap, button or some other similar device. What is important is that the sock support function to hold up the sock of the player.

In the preferred embodiment, the undergarment 10 further comprises a lint protection patch 28 corresponding to each support patch 26. Preferably, the lint protection patch 28 is coupled to the upper edge of each support patch 26, so that the lint protection patch 28 is rotatably moveable so as to be able to cover the support patch 26.

The lint protection patch 28 preferably comprises the "loop" half of the VELCRO™ system. Thus, when the lint protection patch 28 is rotated and pressed against the support patch 26, it is held in place by the hooks of the sock support 26.

The purpose of the lint protection patch 28 is to cover the support patch 26 when the undergarment 10 is not in use, and in particular, when the undergarment 10 is being washed. The covering of the support patch 26 by the lint protection patch 28 prevents lint from becoming enmeshed in the filament-like hooks of the support patch 26, particularly when the undergarment 10 is being washed, or dried in a dryer.

The undergarment 10 preferably further comprises a genital protector support in the form of a protector pocket 30. The protector pocket 30 is preferably openable, and most preferably has VELCRO™ closure 32 for keeping the protector pocket 30 closed while in use.

It will be appreciated that, though the protector pocket may be sealed, it is most preferable that it be openable because, that way, the genital protector can be taken in and out. In particular, when a rigid plastic "jock" or "cup" is used, it is preferable to be able to remove it prior to washing the undergarment 10 in a washing machine or drying it in a dryer. Otherwise, the jock will bang on the walls of the washer or dryer, creating unpleasant and unnecessary noise.

In use, the undergarment 10 also preferably includes a genital protector 31 supported within the protector pocket 30. The preferred genital protector 31 will take different forms depending on the person using the undergarment 10. For male players, a rigid, lightweight plastic genital protector (known as a "cup" or "jock"), shaped to cover and protect the male genitals, is preferred. For female players, the preferred genital protector is a padded protector (often referred to as a "jill", as opposed to the "jock" used by male players). This padded protector can be inserted into the protector pocket 30 for female players to absorb the impact of a puck or stick hitting the genital area.

It will be appreciated that the genital protector support need not necessarily take the form of a protector pocket 30 as described above. Rather, the genital protector support may take any form which allows it to support a genital protector in the appropriate location during use of the undergarment 10. The genital protector support can be a pocket (openable or not) on the inside or outside of the genital area of the undergarment 10. Alternatively, the genital protector may be sewn directly onto the undergarment 10, in which case the thread used for sewing the genital protector would function as the genital protector support. In another alternative, the undergarment 10 can be manufactured so that the genital protector is formed integrally with the undergarment 10. In that case, the material of the undergarment 10 in the vicinity of the genital protector which holds the genital protector in position would be acting as a genital protector support.

A further alternative is that the undergarment 10 may include an inner pant similar to a man's brief, attached to the torso portion, with a pocket acting as the genital protector support. A still further alternative is for the undergarment 10 to have an inner pant similar in design to a conventional jock strap, attached to the torso portion, to function as the genital protector support. These and other variants could be easily adapted by those skilled in the art. Again, what is important is that the genital protector support function to support the genital protector in the appropriate location for protecting the genitals of the player during play.

The undergarment 10 preferably further comprises a sleeve cuff assembly 34 on each of the sleeves 16 distal from the torso portion 12. Preferably, the sleeve cuff assembly 34 includes a fastening means in the form of an elastic band of fabric 36 which is sufficiently adjustable to allow a wrist guard 38 to be selectively positioned on a wrist of the player. Thus, because of the elasticity of the elastic band of fabric 36, it will grip the arm of the player and allow for the wrist guard 38 to be selectively positioned on the player's arm, while still being comfortable for the player to wear.

It will be appreciated that the fastening means may take a different form than the preferred form described above. For example, the fastening means could comprise a strap wrapped around the sleeve cuff assembly 34 and tightened to hold the wrist guard in place and loosened to allow for adjustment. Other configurations are also possible. What is important is that the fastening means be sufficiently adjustable to allow the wrist guard 38 to be selectively positioned on a wrist of the player.

The sleeve cuff assembly 34 also preferably includes a closed pocket 40 which retains the wrist guard 38 in the sleeve cuff assembly 34. This allows the wrist guard 38 to be covered by the material of the pocket 40 while still being retained in the sleeve cuff assembly 34. The elastic band of fabric 36 is attached to the closed pocket 40 which holds the wrist guard 38, thus coupling the elastic band of fabric 36 to the wrist guard 38.

It will be appreciated that the undergarment 10 will preferably be able to function as a replacement for both underpants and an undershirt. Thus, the undergarment 10, and primarily the torso portion 12, will preferably be composed of a comfortable fabric, and most preferably a stretch material. Stretch materials, such as those materials which include LYCRA™ spandex, provide comfort to a player because such materials will stretch during play to adapt to the widely-varied positions of the player's body. By contrast, a material that does not stretch may constrict the player's movements.

Figure 5:
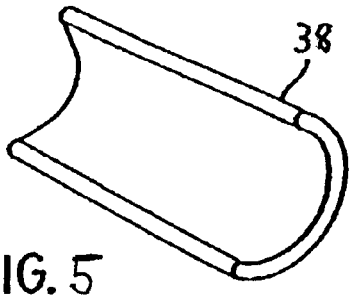
FIG. 5 is an isometric view of a wrist guard.

The wrist guard 38 is preferably sized and shaped as shown in FIG. 5, namely, semi-circular in cross-section to fit over the player's wrist and long enough to cover the player's vulnerable wrist area. The wrist guard 38 will also preferably be composed of a rigid lightweight plastic which protects the player's wrist from impact. It will be appreciated, however, that the wrist guard 38 may be shaped in any way, and made of any material, so long as it prevents or substantially reduces the probability of an impact injury to the player's wrist.

It will also be appreciated that, because hockey players perspire and become quite hot during play, the undergarment 10 will preferably be composed of a breathable material which would allow heat dissipation and maximize player comfort. An example of such a breathable stretch material would be a cotton spandex blend.

It will also be appreciated that, because hockey players perspire and become quite hot during play, the undergarment 10 will preferably be composed of a breathable material which would allow heat dissipation and maximize player comfort. An example of such a breathable stretch material would be a cotton—Lycra™ blend.

Various modifications and alterations are possible to the form of the invention without departing from the scope of the broad claims as attached hereto. For example, while reference has been made to VELCOR™ and to elasticized fabrics, other fastening or positioning means are possible without departing from the scope of the invention.

I claim:

1. An undergarment for use by a hockey player, the undergarment comprising:

a one-piece torso portion having a head opening, and having leg openings and arm openings extending from the one-piece torso portion;

a neck guard assembly comprising an integral neck guard coupled to the torso portion adjacent the head opening, and a releasable attaclunent means coupled to the neck guard to permit the neck guard to be securely positioned on a neck of the player;

at least one sock support positioned adjacent to each of the leg openings extending from the one-piece torso portion;

a closeable opening on the torso portion sized to permit the hockey player to don the undergarment by inserting arms, legs and torso when the closeable opening is open; and a closure to close the closeable opening, the closure being positioned wherein upon the closeable opening being closed by the closure, the undergarment and the sock supports are retained in place on the hockey player.

2. The undergarment of claim 1 further comprising a genital protector support positioned so as to be located at a genital area of the player when the undergarment is in use, the closure being positioned wherein, upon the closeable opening being closed by the closure, the genital protector support is retained in place on the hockey player.

3. The undergarment of claim 1, wherein the neck guard includes at least one layer of cut-resistant fabric.

4. The undergarment of claim 3, wherein the cut-resistant fabric is nylon.

5. The undergarment of claim 1, further comprising a pair of sleeves, each of the sleeves being attached to the torso portion at a corresponding arm opening, and a sleeve cuff assembly on each of the sleeves distal from the torso portion, each sleeve cuff assembly including a fastening means, the fastening means being sufficiently adjustable to allow a wrist guard to be selectively positioned on a wrist of the player, the sleeve cuff assembly being sized and shaped to retain the wrist guard in the sleeve cuff assembly.

6. The undergarment of claim 5, further comprising one wrist guard in each sleeve cuff assembly.

7. The undergarment of claim 5, wherein the fastening means comprises an elastic band of fabric coupled to the wrist guard.

8. The undergarment of claim 6, wherein each sleeve cuff assembly includes a pocket for retaining the wrist guard in the sleeve cuff assembly.

9. The undergarment of claim 8, the pocket being a closed pocket.

10. The undergarment of claim 2, further comprising a genital protector supported by the genital protector support.

11. The undergarment of claim 2, the genital protector support comprising a protector pocket.

12. The undergarment of claim 11, the protector pocket being openable.

13. The undergarment of claim 11, further comprising a genital protector supported in the protector pocket.

14. The undergarment of claim 1, wherein the releasable attachment means comprises at least one piece of elastic material coupled to the neck guard and positioned so as to hold the neck guard on the neck of the player.

15. The undergarment of claim 1, the releasable attachment means comprising the closure, the closure comprising a zipper coupled to the neck guard so as to permit the release of the neck guard by the opening of the zipper and the positioning of the neck guard on the neck of the player by the closing of the zipper.

16. The undergarment of claim 15, the zipper being positioned so that, when the zipper is open, the player may insert arms, torso and legs into the undergarment, the zipper being positioned such that, when closed after the undergarment is donned by the player, the undergarment is retained in place on the player.

17. The undergarment of claim 15, wherein the releasable attachment means further comprises at least one piece of elastic material coupled to the neck guard and positioned so as to hold the neck guard on the neck of the player.

18. The undergarment of claim 1, each pant leg portion carrying two sock supports, one of the sock supports being positioned so as to be located over a back of a player's leg, the other of the sock supports being positioned so as to be located over a front of the player's leg.

19. The undergarment of claim 1, the sock support comprising a support patch of filament-like hooks.

20. The undergarment of claim 19, further comprising one lint protection patch corresponding to each support patch of filament-like hooks, each lint protection patch being movably coupled to one pant leg portion and positioned so as to be movable to cover a corresponding support patch, the lint protection patch comprising loops adapted to be grasped by the filament-like hooks.

21. The undergarment of claim 1, wherein the torso portion is composed of a stretch material.

22. The undergarment of claim 1, the torso portion being composed of a material which is a cotton-spandex blend.

23. The undergarment of claim 1, the undergarment further comprising two pant leg portion extending from the torso portion at the leg openings, and wherein at least one sock support is carried by each pant leg portion.

* * * * *